US011097314B2

(12) United States Patent
Cruz et al.

(10) Patent No.: US 11,097,314 B2
(45) Date of Patent: Aug. 24, 2021

(54) SAND CLEANING SYSTEM AND DEVICE

(71) Applicant: Golftek LLC, Riverton, UT (US)

(72) Inventors: Mar Cruz, Riverton, UT (US); Troy Vandenberghe, Riverton, UT (US)

(73) Assignee: GOLFTEK LLC, Riverton, UT (US)

( * ) Notice: Subject to any disclaimer, the term of this patent is extended or adjusted under 35 U.S.C. 154(b) by 345 days.

(21) Appl. No.: 16/118,119

(22) Filed: Aug. 30, 2018

(65) Prior Publication Data

US 2019/0060955 A1 Feb. 28, 2019

Related U.S. Application Data

(60) Provisional application No. 62/552,379, filed on Aug. 30, 2017.

(51) Int. Cl.

| | |
|---|---|
| ***B07B 1/20*** | (2006.01) |
| ***E01H 12/00*** | (2006.01) |
| ***B07B 1/46*** | (2006.01) |
| ***B07B 1/42*** | (2006.01) |
| ***B07B 1/52*** | (2006.01) |
| ***B07B 1/00*** | (2006.01) |

(52) U.S. Cl.

CPC ..... *B07B 1/20* (2013.01); *B07B 1/005* (2013.01); *B07B 1/42* (2013.01); *B07B 1/4609* (2013.01); *B07B 1/524* (2013.01); *B07B 1/528* (2013.01); *E01H 12/00* (2013.01); *E01H 12/002* (2013.01)

(58) Field of Classification Search

CPC ..... B07B 1/20; B07B 1/528; B07B 1/005; B07B 1/4609; B07B 1/42; B07B 1/524; E01H 12/00; E01H 12/002

See application file for complete search history.

(56) References Cited

U.S. PATENT DOCUMENTS

| | | | | |
|---|---|---|---|---|
| 3,316,977 | A * | 5/1967 | Snook | E01H 12/00 171/25 |
| 4,482,019 | A * | 11/1984 | Murphy | E01H 1/042 171/130 |
| 6,334,538 | B1 * | 1/2002 | Nettles | A01K 1/0114 209/418 |
| 6,540,030 | B2 * | 4/2003 | Ohzeki | E01H 12/00 171/1 |
| 2005/0205270 | A1 * | 9/2005 | Torrey | E01H 12/00 171/1 |
| 2013/0233579 | A1 * | 9/2013 | Ito | E01H 12/002 171/132 |
| 2016/0165832 | A1 * | 6/2016 | Clark | A01K 1/015 209/418 |

* cited by examiner

*Primary Examiner* — Charles A Fox
*Assistant Examiner* — Kalyanavenkateshware Kumar
(74) *Attorney, Agent, or Firm* — Loyal IP Law PLLC; Travis Banta

(57) ABSTRACT

This disclosure relates to a system and device for cleaning impurities, garbage, rocks and etc. from sand. In one embodiment, a sand cleaning device includes a spinning brush head that includes one or more flaps that push sand through a screen while retaining impurities, garbage, and rocks within a receptacle. The system includes a remote power unit for powering the sand cleaning device.

18 Claims, 5 Drawing Sheets

SAND CLEANING SYSTEM AND DEVICE

CROSS-REFERENCE TO RELATED APPLICATIONS

This application claims the benefit of U.S. Provisional Application No. 62/552,379, filed Aug. 30, 2017, entitled "Sand Cleaning System and Device" which is incorporated herein by reference in its entirety, including but not limited to those portions that specifically appear hereinafter, the incorporation by reference being made with the following exception: In the event that any portion of the above-referenced application is inconsistent with this application, this application supercedes said above-referenced application.

BACKGROUND

1. Technical Field

This disclosure relates to a system and device for cleaning impurities, garbage, and rocks from sand. More specifically, the disclosed system provides a series of spinning flaps that pushes sand through a filter screen while separating impurities, garbage, and rocks from the sand. This disclosure further relates to a sand cleaning system in which a sand cleaning device that may be towed behind a vehicle to clean sand and separate debris from the sand into a debris receptacle for later disposal.

2. Description of the Related Art

Sand is a material that has many decorative and natural uses. Beaches, golf courses, sporting arenas (racing tracks, baseball fields, soccer and football field preparations, track and field events, etc.), and many other locations use sand for decoration, ambiance, or to further the aims of a particular activity. For example, in the sport of golf, bunkers, also referred to as "sand traps", must be constantly maintained to prevent adverse effect on a player's golf experience. Rocks, sticks, leaves, garbage or other impurities in the bunker may cause a golfer substantially more difficulty in trying to hit a ball from the bunker. Accordingly, it is desirable for bunkers to be free from impurities. Similarly, it is desirable that natural areas such as beaches appear clean to beachgoers, racing tracks appear manicured to track enthusiasts, and sporting arenas are consistently prepared to enhance performance of athletes using the sporting arena.

Conventional solutions to maintaining sand involve the use of rakes, both handheld and towed behind tractors, to manicure sand. For example, conventional beach cleaners may rake sand with a hand held rake to remove garbage or other impurities from the sand. Alternative solutions have included manicuring the infield of a baseball field, for example, with a towable rake that is connected to a tractor. Other solutions to maintaining sand include people physically walking through the sand and picking up or removing debris by hand or using shovels to re-level sandy areas after use.

These conventional solutions to maintaining sand are incredibly labor intense, especially given the amount of sand on a particular beach or the number of bunkers on a golf course. Golf course bunkers may require several cleanings a day to maintain the bunkers in playable conditions. However, because the task of manicuring sand takes so much time, it is impractical for a team of people to remove all the impurities from sand in the bunkers of a golf course before their services are again required. It is simply not cost effective for people to maintain sand with hand tools and human physical labor.

One other limitation of each of these conventional solutions, with the exception of cleaning by human hand, is that each of these conventional solutions only manicure sand to have a pleasing appearance. That is, handheld and towable rakes merely manicure sand without removing undesirable impurities, garbage, rocks, leaves, sticks, and etc. from the sand. Given that sand is typically in an outdoor environment, impurities may aggregate in sand over time and could either reduce the attractiveness of the sand or the ability of people to functionally use the sand for its intended purpose. Without constant removal of impurities, sand may need to be constantly removed and replaced after use.

Accordingly, a need exists for a sand cleaning system and device that removes impurities from sand. Further, it is one object of this disclosure to provide a system and device for cleaning sand that may be towed behind a vehicle. It is another object of this disclosure to provide a system and device that leaves clean sand with a manicured appearance after cleaning.

SUMMARY

Disclosed herein is a device for cleaning sand. The device includes a motor which drives a brush head unit. The brush head unit includes one or more flaps which rotate on the brush head unit. The one or more flaps push sand through a screen while keeping impurities on the flap until the flap rotates to a point where the flap throws the impurity into a receptacle for later disposal.

Further disclosed herein is a system for cleaning sand in which the device for cleaning sand is attached to a tow vehicle for dragging through sand areas. The tow vehicle may provide power or access to a remote power source for the sand cleaning device to power a motor which drives a brush head unit. The brush head unit includes one or more flaps which rotate on the brush head unit. The one or more flaps push sand through a screen while keeping impurities on the flap until the flap rotates to a point where the flap throws the impurity into a receptacle for later disposal.

BRIEF DESCRIPTION OF THE DRAWINGS

The accompanying drawings illustrate various embodiments of a sand cleaning device and system.

DETAILED DESCRIPTION OF PREFERRED EMBODIMENTS

In the following description, for purposes of explanation and not limitation, specific techniques and embodiments are set forth, such as particular techniques and configurations, in order to provide a thorough understanding of the device disclosed herein. While the techniques and embodiments will primarily be described in context with the accompanying drawings, those skilled in the art will further appreciate the techniques and embodiments may also be practiced in other similar devices.

Reference is now made in detail to the exemplary embodiments, examples of which are illustrated in the accompanying drawings. Wherever possible, the same reference numbers are used throughout the drawings to refer to the same or like parts. It is further noted that elements disclosed with respect to particular embodiments are not restricted to only those embodiments in which they are described. For example, an element described in reference to one embodiment or figure, may alternatively be included in another embodiment or figure regardless of whether or not those elements are shown or described in another embodiment or figure. In other words, elements in the figures may be interchangeable between various embodiments disclosed herein, whether shown or not.

Figure 1:
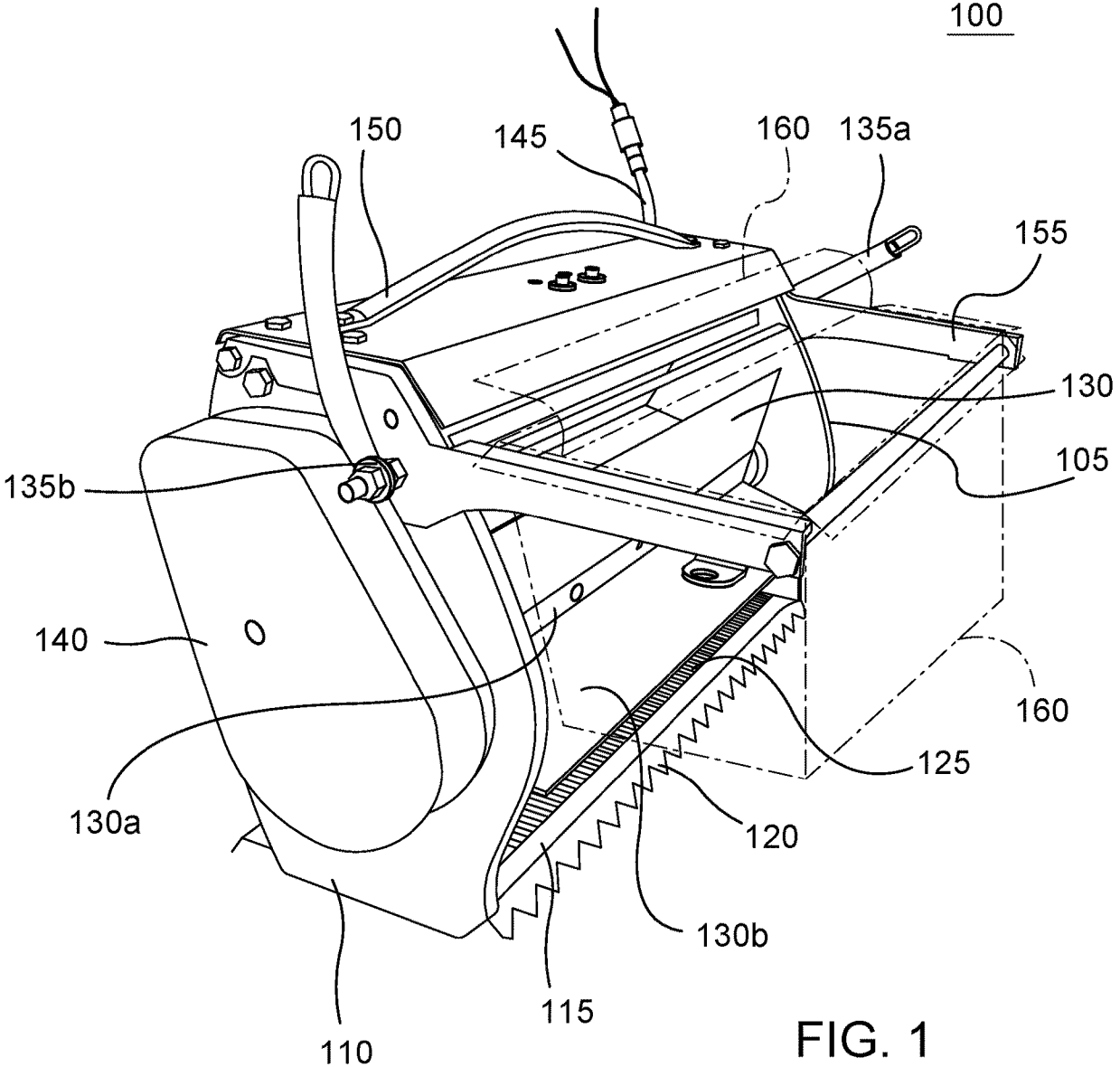
FIG. 1 illustrates a front perspective view of a sand cleaning device.

FIG. 1 illustrates a front perspective view of sand cleaning device 100. Sand cleaning device 100 includes a right side bracket 105 and a left side bracket 110 which are connected to each other by at least a base plate 115. Base plate 115 may include serrations 120, or teeth, disposed along a front portion of base plate 115. As will be discussed below, as sand cleaning device 100 is dragged through sand, base plate 115 may act as a sand scoop to scoop sand over serrations 120 into sand cleaning device 100. Serrations 120 sculpt the surface of sand not scooped over base plate 115 into a series of ridges and valleys, creating a manicured appearance to the sand. Base plate 115 may be further connected to a screen 125 which is sized to allow individual grains of sand to pass through screen 125 while preventing anything larger—debris, impurities, garbage, rocks, sticks, leaves, and etc., from passing through screen 125. Screen 125 may be bent in an arc of approximately 180 degrees from base plate 115 around brush head unit 130 to a top portion of sand cleaning device 100.

Brush head unit 130 may include one or more flaps 130*b* that protrude from a brush head 130*a* in brush head unit 130. In one embodiment, brush head unit 130 may include four flaps that are disposed along brush head unit 130 such that each of the four flaps is approximately spaced about brush head unit 130 at 90 degrees. In this manner, one or more flaps 130*b* are substantially perpendicular to a previous flap or a next flap. Brush head unit 130 may implement one or more flaps 130*b* using a plastic material, such as an ABS plastic. One or more flaps 130*b* on brush head unit 130 are secured to a metal brush head 130*a* that is disposed between right side bracket 105 and left side bracket 110. Brush head unit 130 may spin in a clockwise direction to facilitate being dragged into sand and using one or more flaps 130*b* on brush head unit 130 to circulate sand and debris over screen 125.

Sand cleaning device 100 may further include right drag point 135*a* and left drag point 135*b* to which chains, cordage, webbing, or other connecting material, may be attached. Sand cleaning device 100 may therefore be connected to a tow vehicle which may drag sand cleaning device through for example, a bunker on a golf course, to remove impurities from sand in the bunker. The use of sand cleaning device 100 will be described in further detail below.

Sand cleaning device 100 may further include a drive shaft housing 140 that protects a drive unit that powers brush head unit 130. In the implementation shown in FIG. 1, drive shaft housing 140 may be disposed on left side bracket 110. However, it is conceivable that the construction of sand cleaning device 100 may be reversed such that a drive unit may be implemented on a left side of sand cleaning device 100. In such a case, drive shaft housing 140 may be disposed on right side bracket 105 to meet the designs of a specific implementation of sand cleaning device 100.

Sand cleaning device 100 may obtain power via wiring harness 145 on a top portion of sand cleaning device 100, which connects to a remote power source (not shown), such as power provided by a tow vehicle (not shown). Sand cleaning device 100 may be powered by a 24 volt power source. Sand cleaning device 100 may further include a handle 150 on a top portion of sand cleaning device 100 to allow a person to lift and move sand cleaning device 100, as desired.

Finally, sand cleaning device 100 includes a rectangular bracket 155 for containing a basket 160. Bracket 155 may extend forward of right drag point 135*a* and left drag point 135*b* and form a rectangle. Basket 160 may be disposed within bracket 155 to receive and collect debris that does not fall through screen 125. However, basket 160 is removable from bracket 155. In this manner, basket 160 may collect debris thrown into basket 160 by brush head unit 130 until such a point as a user removes basket 160 from bracket 155 to dispose of the debris collected in basket 160. Basket 160 may further include a mesh bottom which allows anything smaller than a theoretical ¼" sphere to fall through basket 160. Thus, any sand that is propelled into basket 160 may fall through basket 160 and not accumulate within basket 160.

In practice, sand cleaning device 100 may be disposed in a sand area, for example, a golf bunker, by a user. Sand cleaning device 100 may be connected to a tow vehicle (not shown) by the user via right drag point 135*a* and left drag point 135*b*. The user may further connect sand cleaning device 100 to a remote power source via wiring harness 145 on sand cleaning device 100. Once connected, the user may drive the tow vehicle forward, dragging sand cleaning device 100 through the sand. As sand cleaning device 100 is dragged through the sand, base plate 115 augers into the sand such that between the top ½" and 3" of sand in the exemplary bunker is scooped into sand cleaning device 100 by base plate 115. As sand is scooped into sand cleaning device 100 over base plate 115, brush head unit 130 spins about an axis horizontal to the sand and parallel to base plate 115. One or more flaps 130*b* on brush head unit 130 push sand by centrifugal force through screen 125. However, any debris in the sand greater in size than approximately a ¼" sphere does not pass through screen 125 and is carried around brush head unit 130 until centrifugal force supplied by brush head unit 130 throws the debris into basket 160.

In practice, a tow vehicle may pull sand cleaning device at about ⅓ of the speed of a conventional motorized rake that is doing nothing more than raking the sand, which when viewed in terms of the time required to both rake and clean an equal surface area of sand is a vast improvement over conventional solutions. Further, sand cleaning device 100 is reliable in terms of catching any debris greater than about ¼" in size and depositing the debris within basket 160 of sand cleaning device 100.

Figure 2:
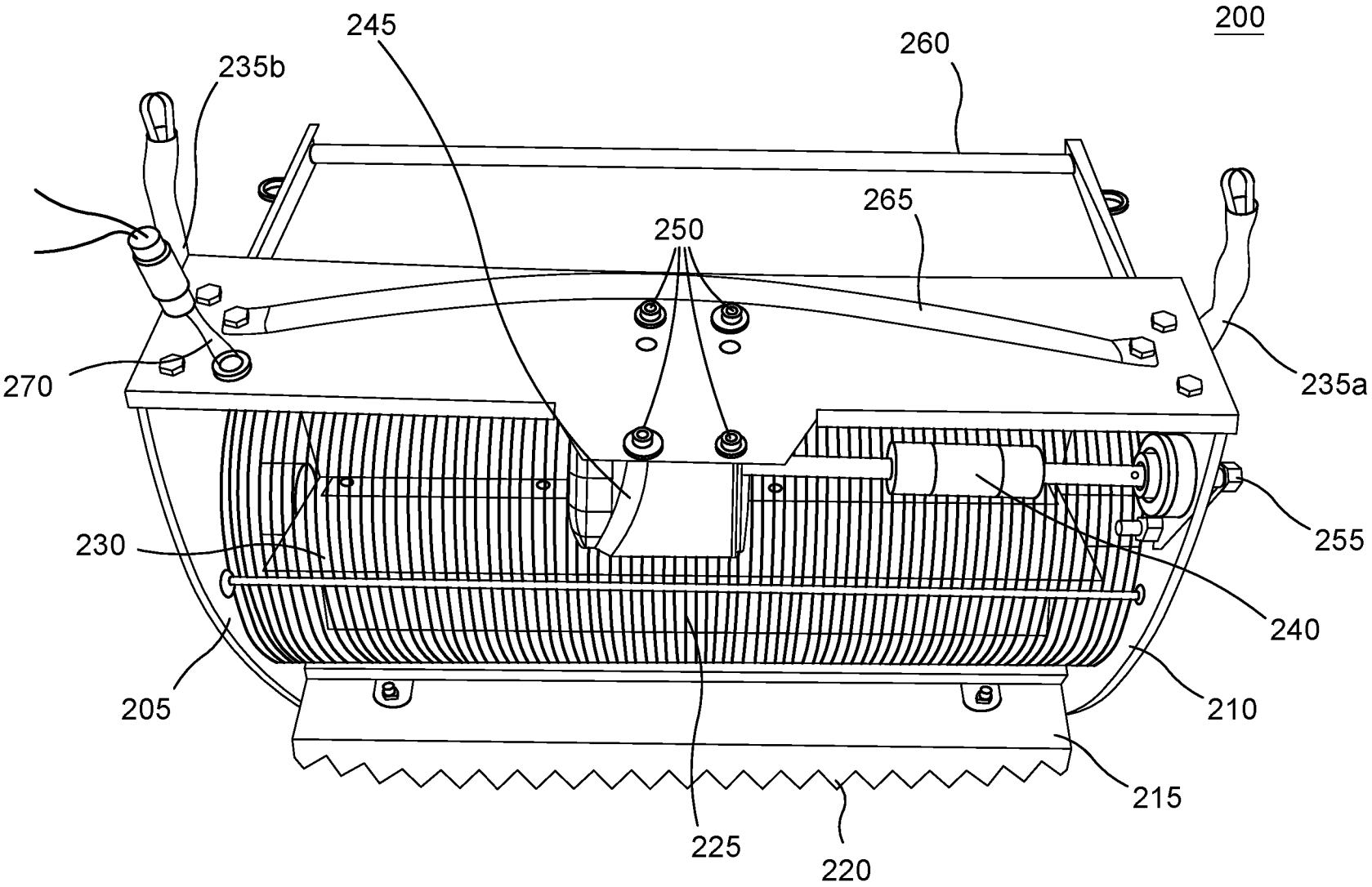
FIG. 2 illustrates a rear top-down view of the sand cleaning device.

FIG. 2 illustrates a rear top-down view of sand cleaning device 200. Sand cleaning device 200 includes a right side bracket 205 and a left side bracket 210. It should be noted that the terms "right" and "left" maintain the orientation of sand cleaning device 100 shown in FIG. 1 even though right side bracket 205 and left side bracket 210 are shown on the left and right sides of FIG. 2, respectively. Connected between right side bracket 205 and left side bracket 210 is a base plate 215, which is similar in implementation and description to base plate 115, shown in FIG. 1. Base plate 215 may further include serrations 220 that are positioned such that the ridges and valleys of serrations 220 are directly in line with serrations 120, shown in FIG. 1. In this manner, serrations 220 manicure the sand by arranging sand into a plurality of ridges and valleys as serrations 220 are dragged through the sand.

Sand cleaning device 200 includes a screen 225 which is similar in description and implementation to screen 125, shown in FIG. 1. Base plate 215 may be connected to a screen 225 which is sized to allow individual grains of sand to pass through screen 225 while preventing anything larger—debris, impurities, garbage, rocks, sticks, leaves, and etc., from passing through screen 225. Screen 225 may be bent in an arc of approximately 180 degrees from base plate 215 to a top portion of sand cleaning device 100. In a preferred embodiment, screen 225 may allow a theoretical sphere of ¼" or smaller to pass through the screen. Anything equal to or larger in size than the ¼" theoretical sphere may be spun around screen 225 by brush head unit 230 into a receptacle, as discussed above with respect to brush head unit 130, shown in FIG. 1.

Sand cleaning device 200 may be propelled by a separate vehicle by dragging sand cleaning device 200 through a sand area. Sand cleaning device 200 may include one or more drag points that connect sand cleaning device 200 to a tow vehicle. FIG. 2 illustrates two drag points 235*a* and 235*b* which are bolted to sand cleaning device 200 as chains which may serve as a connection point between the tow vehicle and sand cleaning device 200. However, it should be noted that fewer or more drag points 235*a* and 235*b* may be implemented to fit a specific need. For example, sand cleaning device 200 may operate with a single centrally mounted drag point or may operate with a plurality of drag points depending on, for example, a depth of sand to be cleaned.

Sand cleaning device 200 includes a shaft 240 mounted to a motor 245. Motor 245 may be connected to sand cleaning device 200 by motor mounts 250. Motor 245 may further be connected to a sprocket 255 by shaft 240. As motor 245 spins, shaft 240 spins which in turn spins sprocket 255. As will be described below, sprocket 255 may be connected to another sprocket which powers brush head unit 230. In one embodiment, motor 245 may be implemented as a 24 volt motor.

Sand cleaning device 200 may further include a basket mount 260 which may removably contain a receptacle for catching and removing undesirable debris from sand. To facilitate movement of sand cleaning device 200 between sand areas, sand cleaning device 200 may include a handle 265. Further, sand cleaning device may include a wiring harness 270 which electrically connects sand cleaning device 200 to a remote power source, as will be discussed below.

Figure 3:
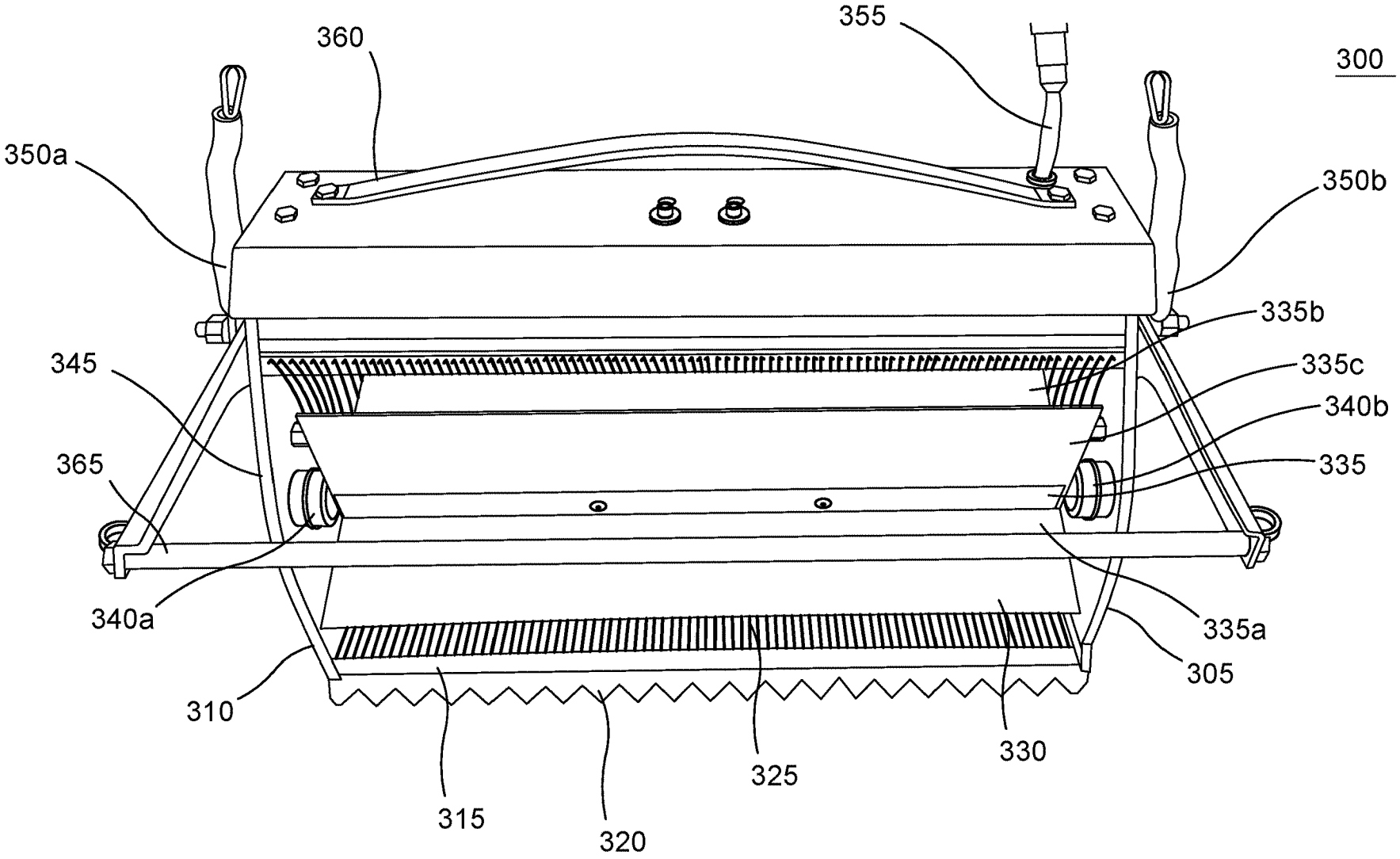
FIG. 3 illustrates a front top-down view of the sand cleaning device.

FIG. 3 illustrates a front top-down view of sand cleaning device 300. Sand cleaning device 300 includes a right side bracket 305 and a left side bracket 310 which are connected to each other by at least a base plate 315. Base plate 315 may include serrations 320, or teeth, disposed along a front portion of base plate 315. As sand cleaning device 300 is dragged through sand, base plate 315 may scoop sand over serrations 320 into sand cleaning device 300. Serrations 320 sculpt the surface of sand not scooped over base plate 315 into a series of ridges and valleys, creating a manicured appearance to the sand. Base plate 315 may be further connected to a screen 325 which is sized to allow individual grains of sand to pass through screen 325 while preventing anything larger—debris, impurities, garbage, rocks, sticks, leaves, and etc., from passing through screen 325. Screen 325 may be bent in an arc of approximately 180 degrees from base plate 315 around brush head unit 330 to a top portion of sand cleaning device 100.

Brush head unit 330 may include a brush head shaft 335 about which are disposed one or more flaps, such as flaps 335*a*, 335*b*, and 335*c* that protrude from brush head shaft 335. Another flap, not shown that is parallel to flap 335*c* and perpendicular to flaps 335*a* and 335*b*, may also be disposed about brush head shaft 335 in brush head unit 330. Each of the one or more flaps 335*a*, 335*b*, and 335*c* is approximately spaced about brush head unit 330 at 90 degrees. In this manner, the one or more flaps 335*a*, 335*b*, and 335*c* are substantially perpendicular to a previous flap or a next flap. Brush head unit 330 may implement one or more flaps 335*a*, 335*b*, and 335*c* using a plastic material, such as an ABS plastic. One or more flaps 335*a*, 335*b*, and 335*c* on brush head unit 330 are secured to brush head shaft 335 by screws, rivets, or another conventional fastener. Brush head shaft 335 may be secured between right side plate 305 and left side plate 310 by bearing 340*a* mounted on left side plate 310 and bearing 340*b* mounted on right side plate 305. A sprocket 345 may be mounted to brush head shaft 335 on an outside portion of left side plate 310 which may be used to drive and spin brush head shaft 335 during operation.

Sand cleaning device 300 may further include left drag point 350*a* and right drag point 350*b* to which chains, cordage, webbing, or other connecting material, may be attached. Sand cleaning device 300 may therefore be connected to a tow vehicle which may drag sand cleaning device through for example, a bunker on a golf course, to remove impurities from sand in the bunker.

Sand cleaning device 300 may obtain power via wiring harness 355 on a top portion of sand cleaning device 300, which connects to a remote power source (not shown), such as power provided by a tow vehicle (not shown). Sand cleaning device 300 may be powered by a 24 volt power source. Sand cleaning device 300 may further include a handle 360 on a top portion of sand cleaning device 300 to allow a person to lift and move sand cleaning device 300, as desired.

Finally, sand cleaning device 300 includes a rectangular bracket 365 for containing a basket (not shown). Bracket 365 may extend forward of left drag point 350*a* and right drag point 350*b* and form a rectangle. A basket, such as basket 160 shown in FIG. 1, may be disposed within bracket 365 to receive and collect debris that does not fall through screen 325. However, as shown in FIG. 3, basket 160 is removable from bracket 165 and has been removed for purposes of explanation.

Figure 4:
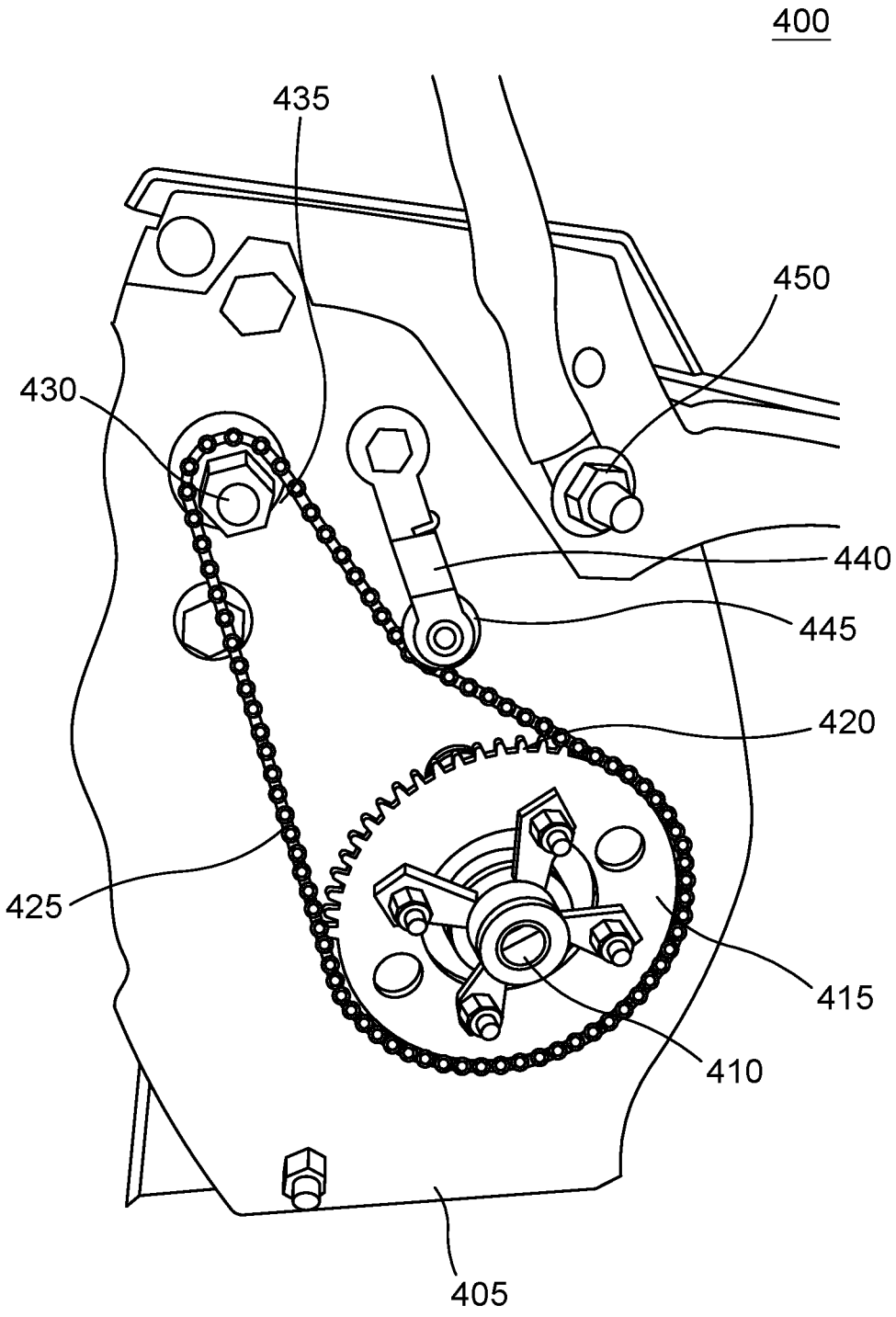
FIG. 4 illustrates a side view of a drive unit of the sand cleaning device.

FIG. 4 illustrates a side view of a drive unit 400 of a sand cleaning device, such as sand cleaning device 100, shown in FIG. 1, sand cleaning device 200, shown in FIG. 2, and sand cleaning device 300, shown in FIG. 3. Drive unit 400 may be mounted on a bracket 405 and include a shaft 410 which is secured to a sprocket 415. Shaft 410 may be implemented as, for example, brush head shaft 335, shown in FIG. 3. One or more teeth 420 on sprocket 415 may interconnect with chain 425 which drives sprocket 415 and shaft 410 by electrical power supplied by sprocket 430 which may be attached to a drive shaft 430 connected to a motor, such as motor 245, shown in FIG. 2.

In this manner, motor 245 may connect to drive shaft 430 upon which sprocket 435 is connected to sprocket 415 by chain 425, thereby driving and spinning shaft 410. In one embodiment, a gear ration of 5:1 may be implemented between sprocket 435 and sprocket 415 to ensure appropriate torque and rotation speeds are applied to shaft 410. To ensure that chain 425 remains connected between sprocket 435 and sprocket 415, a spring-loaded tensioner 440 may be provided with a wheel 445 which rides along chain 420. Tensioner 440 operates by effectively extending a length of travel for chain 425 to ensure that chain 425 remains tightly in place between sprocket 415 and sprocket 435. Drag point 450 may be positioned forward of drive unit 400 to ensure that any attachment connected to drag point 450 stays clear of drive unit 400.

Figure 5:
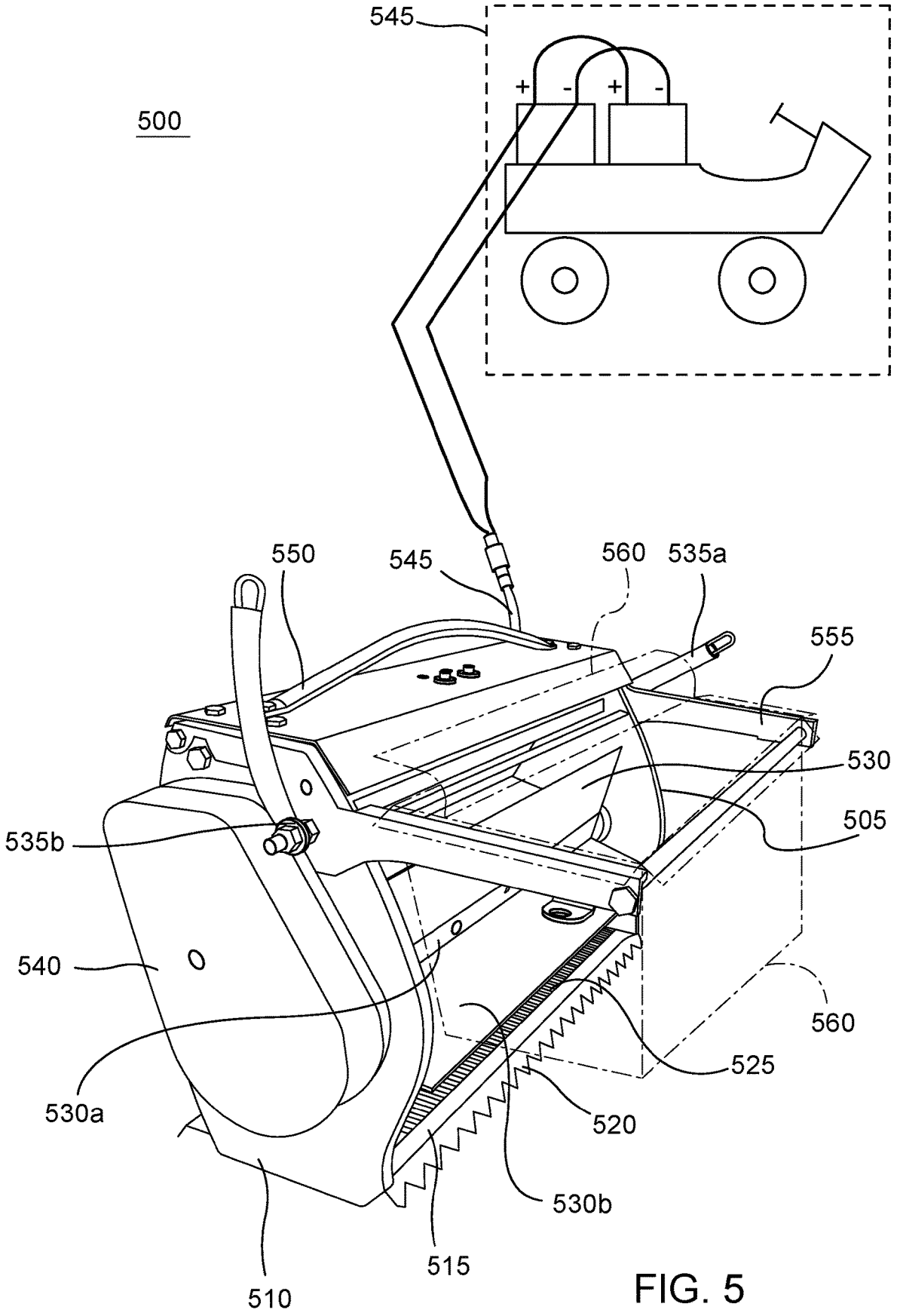
FIG. 5 illustrates a view of a sand cleaning system.

FIG. 5 illustrates a view of a sand cleaning system 500. Sand cleaning system 500 may be implemented with a sand cleaning device, such as sand cleaning device 100 shown in FIG. 1, sand cleaning device 200 shown in FIG. 2 and sand cleaning device 300 shown in FIG. 3. The sand cleaning device includes a right side bracket 505 and a left side bracket 510 which are connected to each other by at least a base plate 515. Base plate 515 may include serrations 520, or teeth, disposed along a front portion of base plate 515. As the sand cleaning system is dragged through sand, base plate 515 may scoop sand over serrations 520 into sand cleaning system 500. Serrations 520 sculpt the surface of sand not scooped over base plate 515 into a series of ridges and valleys, creating a manicured appearance to the sand. Base plate 515 may be further connected to a screen 525 which is sized to allow individual grains of sand to pass through screen 525 while preventing anything larger—debris, impurities, garbage, rocks, sticks, leaves, and etc., from passing through screen 525. Screen 525 may be bent in an arc of approximately 180 degrees from base plate 515 around brush head unit 530 to a top portion of sand cleaning system 500.

Brush head unit 530 may include one or more flaps 535*b* that protrude from brush head 530*a*. In one embodiment, brush head unit 530 may include four flaps that are disposed along brush head 530*a* such that each of the four flaps is approximately spaced about brush head 530*a* at 90 degrees. In this manner, one or more flaps 535*b* are substantially perpendicular to a previous flap or a next flap. Brush head unit 530 may implement one or more flaps 535*a* using a plastic material, such as an ABS plastic. One or more flaps 535*a* on brush head unit 530 are secured to metal brush head 530*a* that is disposed between left side bracket 505 and right side bracket 510. Brush head unit 530 may spin in a clockwise direction to facilitate being dragged into sand and using the one or more flaps on brush head unit 530 to circulate sand and debris over screen 525.

Sand cleaning system 500 may further include right drag point 535*a* and left drag point 535*b* to which chains, cordage, webbing, or other connecting material, may be attached. Sand cleaning system 500 may therefore be connected to a tow vehicle which may drag sand cleaning device through for example, a bunker on a golf course, to remove impurities from sand in the bunker. The use of sand cleaning system 500 will be described in further detail below.

Sand cleaning system 500 may further include a drive shaft housing 540 that protects a drive unit that powers brush head unit 530. In the implementation shown in FIG. 5, drive shaft housing 540 may be disposed on right side bracket 510. However, it is conceivable that the construction of sand cleaning system 500 may be reversed such that a drive unit may be implemented on a left side of sand cleaning system 500. In such a case, drive shaft housing 540 could be disposed on left side bracket 505 to meet the designs of a specific implementation of sand cleaning system 500.

Sand cleaning system 500 may obtain power via wiring harness 545 on a top portion of sand cleaning system 500, which connects to a remote power source 565. Remote power source 565 may be implemented by a tow vehicle that supplies power to sand cleaning system 500 via wiring harness 545. Remote power source 565 may be a 24 volt power source. In one embodiment, remote power source 565 may include one or more 12 volt batteries connected in a series electrical configuration to generate 24 volts of electrical power. In another embodiment, remote power source 565 may be supplied by one or more batteries that power the tow vehicle. In another embodiment, remote power source 565 may be implemented by a gasoline powered engine which includes an electrical alternator for generating a DC (direct current) current at 24 volts to supply power to sand cleaning system 500. Hybrids of these embodiments are also possible. For example, it may be possible for a gasoline powered engine which includes an electrical alternator to provide electrical power to one or more batteries which, in turn, provide power to sand cleaning system 500. Sand cleaning system 500 may further include a handle 550 on a top portion of sand cleaning system 500 to allow a person to lift and move sand cleaning system 500, as desired.

Finally, sand cleaning system 500 includes a rectangular bracket 555 for containing a basket 560. Bracket 555 may extend forward of right drag point 535*a* and left drag point 535*b* and form a rectangle. Basket 560 may be disposed within bracket 555 to receive and collect debris that does not fall through screen 525. However, basket 560 is removable from bracket 555. In this manner, basket 560 may collect debris thrown into basket 560 by brush head unit 530 until such a point as a user removes basket 560 from bracket 555 to dispose of the debris collected in basket 560. Basket 560 may further include a mesh bottom which allows anything smaller than a theoretical ¼" sphere to fall through basket 560. Thus, any sand that is propelled into basket 560 may fall through basket 560 and not accumulate within basket 560.

The foregoing description is presented for purposes of illustration. It is not exhaustive and does not limit the invention to the precise forms or embodiments disclosed. Modifications and adaptations will be apparent to those skilled in the art from consideration of the specification and practice of the disclosed embodiments. For example, components described herein may be removed and other components added without departing from the scope or spirit of the embodiments disclosed herein or the appended claims.

Other embodiments will be apparent to those skilled in the art from consideration of the specification and practice of the disclosure disclosed herein. It is intended that the specification and examples be considered as exemplary only, with a true scope and spirit of the invention being indicated by the following claims.

What is claimed is:

1. A sand cleaning system, comprising:
a drag point that connects to a tow vehicle;
a debris receptacle; and
a sand cleaning device, comprising:
a scoop on a base plate that scoops sand into a sand cleaning device;
a screen bent in an arc of approximately 180 degrees relative to the base plate that separates undesirable debris from sand;
a drive unit having a power source which rotates a brush head.

2. The sand cleaning system of claim 1, further comprising a drive unit that includes a gasoline engine.

3. The sand cleaning system of claim 1, further comprising a drive unit and a battery.

4. The sand cleaning system of claim 1, wherein the scoop includes the base plate that is connected to the screen.

5. The sand cleaning system of claim 1, wherein the brush head includes a flap.

6. The sand cleaning system of claim 1, wherein the brush head includes a plurality of flaps.

7. The sand cleaning system of claim 5, wherein the flap rotates about the brush head to move debris from the screen to the debris receptacle.

8. The sand cleaning system of claim 1, wherein the scoop includes serrations.

9. The sand cleaning system of claim 1, further comprising a drive unit that includes a drive sprocket.

10. The sand cleaning system of claim 9, wherein the drive unit includes a drive shaft.

11. The sand cleaning system of claim 10, wherein a chain is connected to the sprocket.

12. The sand cleaning system of claim 11, wherein the chain is held in tension by a spring-loaded tensioner.

13. A sand cleaning device, comprising:

a scoop;

a screen bent in an arc of approximately 180 degrees;

a brush head including one or more flaps; and a motor connected to the brush head to drive the brush head.

14. The sand cleaning device of claim 13, further comprising a base plate including a plurality of serrations.

15. The sand cleaning device of claim 13, further comprising a removable debris receptacle.

16. The sand cleaning device of claim 13, further comprising a drive unit that connects the motor to the brush head.

17. The sand cleaning device of claim 16, wherein the drive unit includes a first sprocket and a first drive shaft.

18. The sand cleaning device of claim 17, wherein the drive unit includes a second sprocket and a second drive shaft.

* * * * *